US007412789B2

(12) United States Patent
Jensen et al.

(10) Patent No.: US 7,412,789 B2
(45) Date of Patent: Aug. 19, 2008

(54) PROCESS FOR ALIGNING A LAUNDRY ARTICLE AND DEVICE FOR CARRYING OUT THE PROCESS

(75) Inventors: Jesper Munch Jensen, Gumligen (CH); Thomas Knofel, Burgdorf (CH); Martin Rauch, Hasle-Rueggsau (CH)

(73) Assignee: Jensen AG Burgdorf, Burgdorf (CH)

( * ) Notice: Subject to any disclaimer, the term of this patent is extended or adjusted under 35 U.S.C. 154(b) by 89 days.

(21) Appl. No.: 11/354,055

(22) Filed: Feb. 15, 2006

(65) Prior Publication Data

US 2006/0191170 A1 Aug. 31, 2006

(30) Foreign Application Priority Data

Feb. 15, 2005 (EP) ..... 05405191

(51) Int. Cl.
*D06F 67/04* (2006.01)
*D06F 69/02* (2006.01)

(52) U.S. Cl. ..... 38/143

(58) Field of Classification Search ..... 38/143; 414/800; 271/308
See application file for complete search history.

(56) References Cited

U.S. PATENT DOCUMENTS 4,979,868 A * 12/1990 Ueda et al. ..... 414/800
5,168,645 A * 12/1992 Robin et al. ..... 38/143
5,168,648 A 12/1992 Brandl et al.
5,169,282 A 12/1992 Ueda et al.
5,416,992 A * 5/1995 Ueda et al. ..... 38/143
6,584,711 B1 * 7/2003 Nakamura ..... 38/143
7,127,840 B2 * 10/2006 McCabe ..... 38/143

FOREIGN PATENT DOCUMENTS

| | | | |
|---|---|---|---|
| EP | 0 272 368 | A1 | 6/1988 |
| EP | 0 751 251 | A | 1/1997 |
| EP | 0 794 279 | A1 | 3/1997 |
| GB | 2 219 313 | A | 12/1989 |
| WO | WO 96/03 540 | A2 | 2/1996 |

OTHER PUBLICATIONS

U.S. Appl. No. 11/354,181, filed Feb. 15, 2006, Jensen et al.

* cited by examiner

*Primary Examiner*—Ismael Izaguirre
(74) *Attorney, Agent, or Firm*—Oliff & Berridge, PLC

(57) ABSTRACT

A laundry article is drawn over a support surface by a positioning gripper and is set down there so that the rearmost tip comes to rest on an edge plate and the remainder on a transverse conveyor which moves the laundry article to a corner gripping apparatus. The latter is then moved to the edge plate, optical sensors located above said edge plate registering edge points of the laundry article. The position of the corner is determined whereupon the corner gripping apparatus approaches the tip determined and a corner gripper is advanced from the gripping edge so that a lower jaw thereof grips under the edge plate. An upper jaw is then lowered onto the corner of the laundry article. The corner gripper is then withdrawn so that the corner is clamped between the upper jaw and the lower jaw of the corner gripper.

32 Claims, 8 Drawing Sheets

PROCESS FOR ALIGNING A LAUNDRY ARTICLE AND DEVICE FOR CARRYING OUT THE PROCESS

FIELD OF THE INVENTION

The invention relates to a process for aligning a laundry article, as used, for example, in laundries for preparing the laundry article for input into a processing device, for example a folding apparatus or a mangle. It relates in particular to the automatic implementation of a step in the alignment, namely the finding and gripping of a corner of the laundry article. The invention also relates to a device suitable for carrying out the process.

PRIOR ART

Laundry articles, such as bed sheets, towels and the like, are generally present in disordered heaps, for example after washing and drying, but must be fed with a stretched front edge to devices which carry out subsequent processing steps, such as folding apparatuses or mangles, so that orderly processing is ensured. Feed apparatuses having two clamps into which two corners of the respective laundry article which bound an edge are introduced manually and which then automatically grip the corners and move apart to stretch the edge and then place the stretched edge and a part of the laundry article adjacent thereto on a conveyor belt which then feeds the laundry article to the processing device have therefore long been known, cf. e.g. EP 0 794 279 A1. The finding and gripping of the corners and the introduction thereof into the clamps constitute monotonous work which is relatively strenuous, especially since it generally has to be carried out in a warm and humid environment.

Various attempts have therefore already been made to automate this operation completely or partly.

Thus, WO 96/03 540 A2 describes a device for aligning laundry articles, in which approximately the middle of an edge of the respective laundry article is manually gripped and is placed on a narrow conveyor belt, clamped by a further conveyor belt above the latter and fed to a feed apparatus. On both sides of the conveyor belt, in each case the rearmost tip of the laundry article is fixed and clamped. These tips correspond to the corners of the edge which is at the rear in the transport direction and are gripped by clamps which then move apart and place the stretched edge as the front edge on a downstream broad conveyor belt. Here too, manual intervention is required, which is also not without difficulties since the mid point of an edge has to be found and positioned with a certain accuracy.

GB 2 219 313 A1 describes a device for gripping laundry articles, comprising a perpendicular pivot beam carrying a longitudinally displaceable first edge gripper, in which only one corner of the respective laundry article is manually introduced into a clamp and the latter is moved adjacent to the edge gripper which is to travel along an edge adjacent to the gripped corner and to grip the opposite corner and comprising a second edge gripper which takes over the initially gripped corner, whereupon the pivot beam pivots into a horizontal position and the corners are transferred to clamps of a feed apparatus which then stretches the edge. In the case of this device, manual input of a corner is required. Moreover, the extent to which the gripping of the lower edge by the first edge gripper takes place in a sufficiently reliable manner is questionable since the edge is as a rule not likely to be freely accessible.

U.S. Pat. No. 5,169,282 A describes a device comprising a first gripper into which a corner of the respective laundry article is manually introduced and which is then raised by about 50 cm, an edge adjacent to the corner being pulled through a second gripper, which is then closed. The two grippers between which a piece of an edge adjacent to the corner is thus stretched are then moved, with the other edge adjacent to the corner towards the front, to a first rail section which runs away obliquely down towards the upper end of a perpendicular second rail section on which a longitudinally displaceable first edge gripper, a similar edge and corner sensor and a longitudinally displaceable second edge gripper at the upper end are arranged.

The first rail section is pivotable about an axis located at the upper end of the second rail section and is pivoted downwards until the front edge adjacent to the corner is perpendicular, and is detected by the edge and corner sensor. Thereafter, the first edge gripper is moved downwards together with said edge and corner sensor, the corner is fixed at the lower end of the edge and is gripped by the first edge gripper, while the second edge gripper takes over the upper corner. The edge grippers are then moved to a horizontal rail section adjacent to the perpendicular rail section so that the edge stretched between them is now at the top. The laundry article is thus ready for transfer. Here too the manual input of a corner is required and moreover the gripping of a second point on the adjacent edge involves uncertainties.

Finally, U.S. Pat. No. 5,168,645 A discloses a process and a corresponding device for aligning a laundry article with a corner gripping apparatus and a preliminary gripper having a suction head which can be raised from a gripping position in which it can suck up a laundry article in an open container at an arbitrary point, to a transfer position in which the laundry article is gripped and taken over in the vicinity of the suction point by a positioning gripper and is drawn through a channel, the rearmost tip of the laundry article being detected by a sensor and gripped by a corner gripper. The two grippers are then moved on in parallel a distance apart, and the laundry article is drawn over a surface having a middle ridge running in the direction of movement and descending flanks on both sides, with the result that a further corner adjacent to the gripped corner is isolated, so that it can be gripped by a further corner gripper. However, the sequence is evidently prone to some uncertainties.

SUMMARY OF THE INVENTION

It is the object of the invention to improve known processes in such a way that the fixing and gripping of a corner of the laundry article takes place as part of an alignment thereof with a high degree of accuracy and certainty.

It is furthermore the object of the invention to provide a device suitable for carrying out the process.

The process according to the invention and the device for carrying it out have proved their worth. The gripping of a corner is effected in the process according to the invention, in particular if it is carried out by a corner gripping apparatus of the device according to the invention, with great reliability and has no preconditions other than that the laundry article has been gripped beforehand at an arbitrary point, which can be very easily effected by manual input or, preferably, automatically, for example by a suitable apparatus such as a preliminary gripper.

The gripping of a corner provides an advantageous precondition for the gripping of an edge of the laundry article, which permits complete alignment thereof and transfer to a downstream processing device. According to a preferred version of the device according to the invention, the latter comprises an edge gripping apparatus which carries out this step.

BRIEF DESCRIPTION OF THE DRAWINGS

Below, the invention is explained in more detail with reference to figures which show only an embodiment.

DESCRIPTION OF THE PREFERRED EMBODIMENTS

Figure 1:
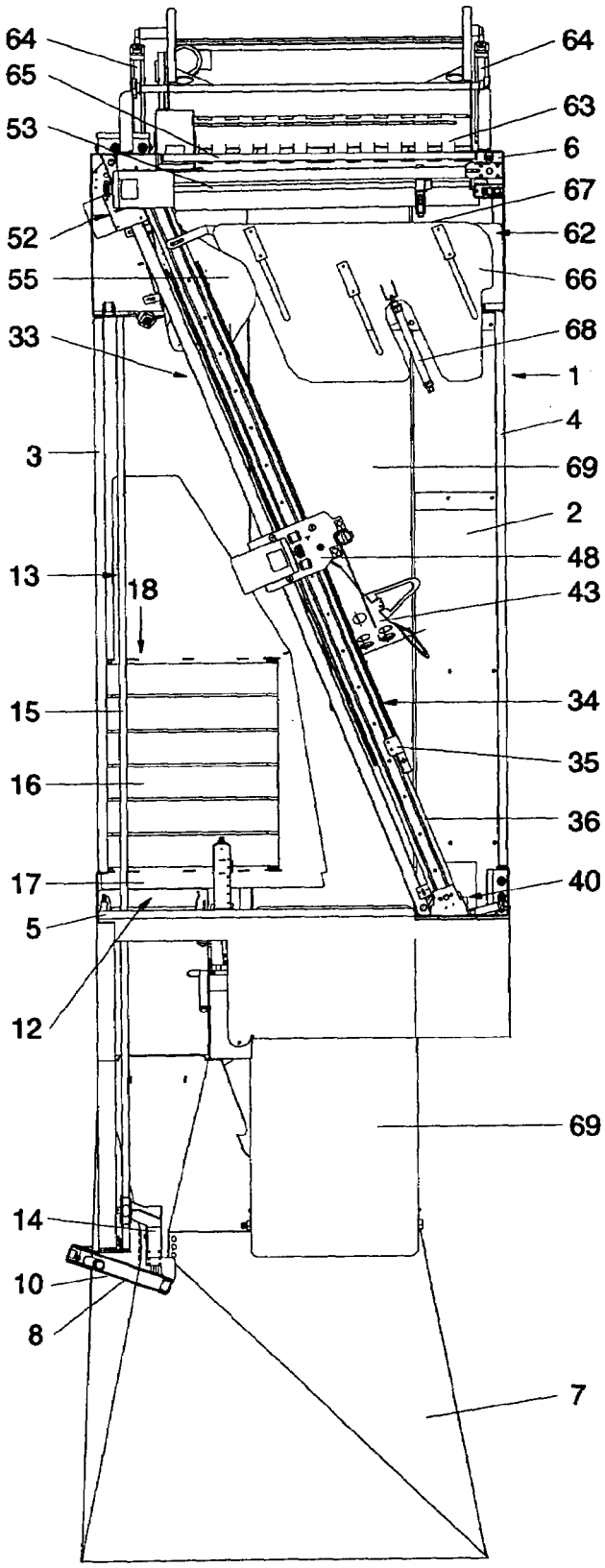
FIG. 1 shows a plan view of a device according to the invention.
Figure 2:
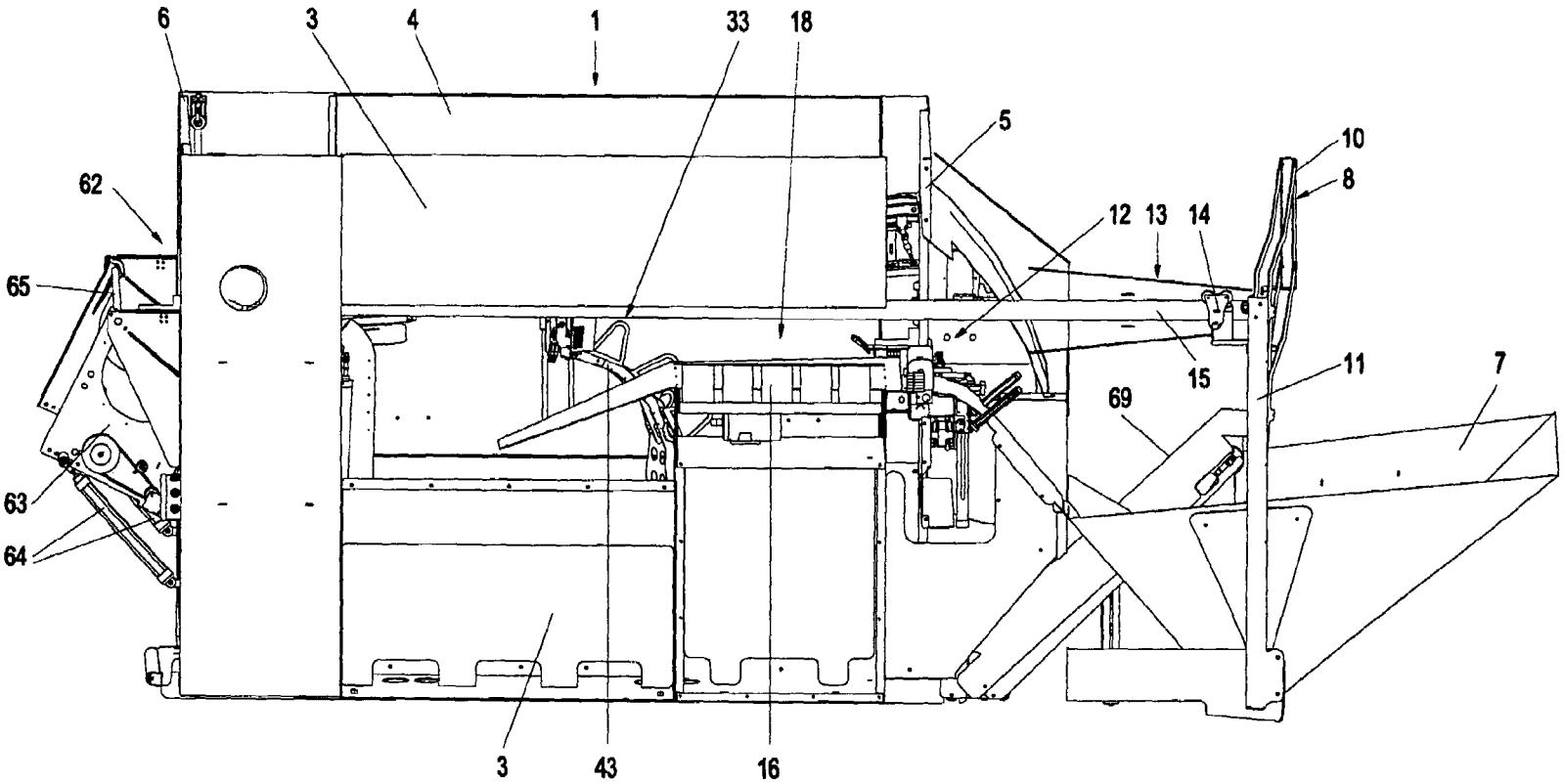
FIG. 2 shows substantially a side view of the device according to the invention, slightly obliquely, from above.

FIG. 1, 2 show an overview of the device according to the invention, and FIG. 3 to 12 show in more detail individual apparatuses and parts of the device approximately in the sequence in which they are used in the processing of a laundry article.

The device comprises (FIG. 1, 2) an approximately cuboid housing 1, having a base 2, side walls 3, 4 having openings in parts, and a front wall 5 and a rear wall 6 which likewise have openings. A container 7 which is open at the top and narrows in a downward direction and, above the lowest point thereof, a preliminary gripper 8 are arranged before the front wall 5, i.e. outside the housing 1 (cf. also FIG. 3). Said preliminary gripper comprises a pneumatic clamp 9 which is directed downwards and is held on a parallelogram suspension 10. The latter is anchored at the upper end of a post 11 fastened to the outside of the container 7, so that the clamp 9 can be moved back and forth between a lower gripping position, in which it dips into the container 7 for gripping a laundry article, and a transfer position close to the upper end of the post 11.

A corner gripping apparatus 12 comprises (cf. also FIG. 4, 5) a positioning conveyor 13 having a positioning gripper 14 in the form of a pneumatic clamp and a rail 15 along which said positioning gripper can move in a positioning direction from a position just below the transfer position through an opening in the front wall 5 into the interior of the housing 1 and further along the side wall 3 and back. In addition, it comprises a transverse conveyor 16, a conveyor belt which runs behind the front wall 5 along a transverse direction perpendicular to the positioning direction from the side wall 3 towards the middle of the housing 1. Towards the front wall 5, a thin edge plate 17 which is part of a frame surrounding the transverse conveyor 16 is arranged adjacent to the transverse conveyor 16. The upper surfaces of the transverse conveyor 16 and of the frame form a support surface whose region closest to the side wall 3 and located immediately below the rail 15 represents a positioning strip 18, before which a light barrier 19 (FIG. 4) is arranged at the edge closest to the front wall 5.

The corner gripping apparatus 12 (FIG. 5) furthermore comprises a holder 20 which is supported by a base 21 so that it can be advanced and withdrawn in the positioning direction, which base is in turn mounted on a slide 22 so that it can be raised and lowered. The slide 22 can be moved back and forth in the transverse direction up to close to the side wall 4 along a rail 23 arranged on the outside of the front wall 5. The holder 20 supports a corner gripper 24 in the form of a pneumatic clamp. In the advanced gripping position of the holder 20 shown in FIG. 5, a lower jaw 25 of the corner gripper 24 and an upper jaw 26 project from a gripping edge 27 of the edge plate 17, opposite the front wall 5, below and above said edge plate, respectively. The former is just below the edge plate 17 while the latter is above it at a distance and can be lowered onto it.

By withdrawing the holder 20, the corner gripper 24 can be withdrawn to such an extent that the lower jaw 25 and the upper jaw 26 are free of the edge plate 17. The corner gripper 24 can be tilted downwards by means of a pneumatic piston 28 into a transfer position shown in FIG. 6.

The holder 20 furthermore supports a tongue 29 which is arranged above the corner gripper 24, projects horizontally above it in the positioning direction and carries an optical scanner 30 and, at the end, a blow nozzle 31 directed obliquely downwards towards the edge plate 17 and the gripping edge 27. The scanner 30 is present immediately above the edge plate 17, the surface of which there forms a scanning strip extending in the transverse direction. Said scanner comprises four optical sensors 32 which are located in succession in the positioning direction with a spacing of 10 mm to 20 mm, preferably about 15 mm, and are each suitable for distinguishing the top of a laundry article from the surface of the edge plate 17 and for determining a transfer from one to the other and vice versa.

An edge gripping apparatus 33 (cf. also FIG. 8,9) comprises a tensioning conveyor 34 having a tensioning gripper 35 and a rail 36 which runs in a tensioning direction approximately diagonally from the corner formed by the front wall 5 and the side wall 4 to the rear end of the side wall 3 through the housing 1 and along which the tensioning gripper 35 can be moved in the tensioning direction and back. The tensioning gripper 35 comprises a pneumatic clamp 37 which is held on a lever 39 in such a way that it can be raised and lowered by a pneumatic piston 38.

Figure 7:
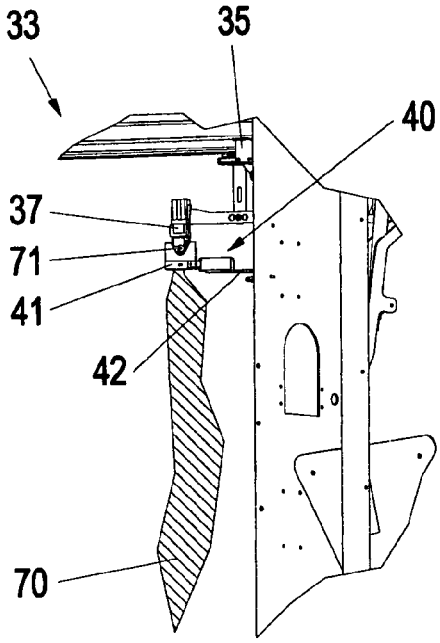
FIG. 7 shows the transfer gripper during the transfer of the laundry article to a tensioning gripper of a tensioning conveyor and, FIG. 8 shows, obliquely to the transport direction, the tensioning conveyor which carries the accepted laundry article, and other parts of an edge gripping apparatus.
Figure 8:
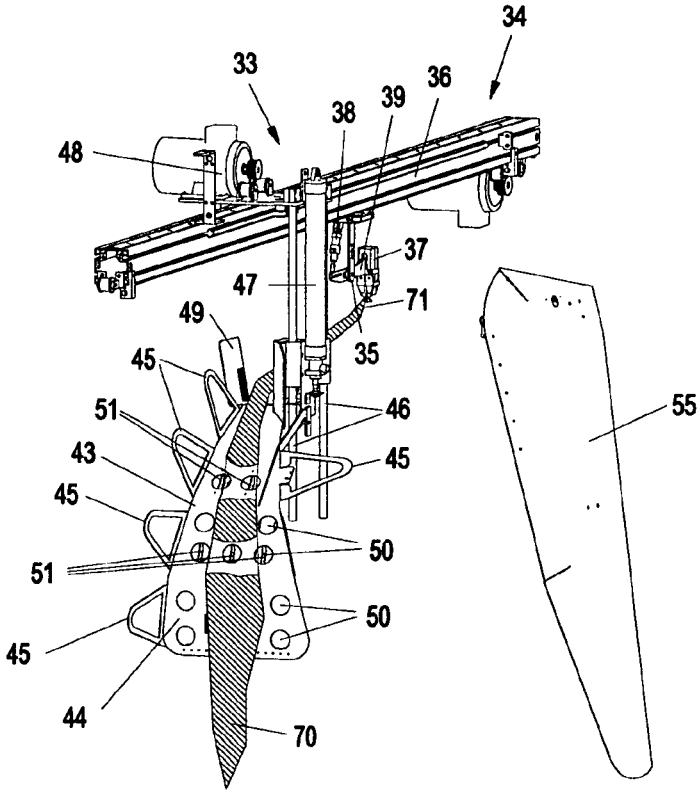

A transfer gripper 40 (cf. also FIG. 6, 7) arranged in the corner between the front wall 5 and the side wall 4 has a pneumatic clamp 41 which is fixed to the end of a horizontal band 42 which is mounted so as to be rotatable through about 90° about a perpendicular axis. The flat jaws of the clamp 41 have, on the top, an approximately V-shaped recess which, in a take-over position (FIG. 6), receives the downward-tilted corner gripper 24 and which is engaged by the clamp 37 of the tensioning gripper 35 in a transfer position (FIG. 7).

The edge gripping apparatus 33 also comprises an end gripping unit having a channel 43 suspended below the rail 36 and having a base 44, for example of sheet metal, which carries upward-pointing bows 45 on both sides as lateral limitations. The base 44 is convex in the tensioning direction, i.e. initially steep and then increasingly flat. It also becomes narrower so that the channel 43 tapers in the tensioning direction. Transverse thereto, the base 44 is flat. The channel 43 is suspended from perpendicular rods 46 along which it can be moved by means of a pneumatic cylinder 47. The rods 46 and the pneumatic cylinder 47 are anchored to a carriage 48 which can be moved along the rail 46. Arranged at the rear end of the channel 43 is a clamping unit having a flap 49 which can be swivelled towards the rear edge of the base 44. In addition, holes 50 are distributed over its base 44, behind some of which holes optical sensors 51 are arranged in two rows in succession a distance apart in the tensioning direction. They form an end sensor unit which serves for controlling the clamping unit.

Arranged at the end of the rail 36 is an edge gripping unit 52 (cf. also FIGS. 10-12) having a pivot beam 53, one end of which is pivotably mounted in a pivot bearing 54 which is mounted in the region of a take-over point slightly below the end of the rail 36. It can therefore be transferred between a take-over position (FIGS. 10, 11), in which it is approximately perpendicular, being inclined downwards slightly towards the tensioning direction and also slightly to one side, and a transfer position (FIG. 12) in which it is horizontal and parallel to the rear wall 6. The edge gripping unit 52 also comprises a guide plate 55, the front of which facing the tensioning direction forms a guide surface located below the rail 36 and extending obliquely relative to the tensioning direction up to the pivot beam 53 in the take-over position. The pivot beam 53 supports a first edge gripper 56 having a clamp 57 and, on that side thereof which faces away from the pivot bearing 54, an optical sensor 58 and, closer to the pivot bearing 54, a second edge gripper 59 having a corresponding clamp 60 and an optical sensor 61. The first edge gripper 56 and the second edge gripper 59 are displaceable along the pivot beam 53. The sensor 58 serves as a corner sensor and the sensor 61 and a further sensor mounted on the first edge gripper 56 serve as edge sensors. On the first edge gripper 56, however, the latter function can also be performed by the sensor 58.

A removal conveyor apparatus 62 (cf. also FIG. 12) is arranged at the rear end of the housing 1. It comprises a removal conveyor 63 which is suspended from the outside of the rear wall 6 and is in the form of a belt conveyor and to which a feed conveyor to a mangle or a folding apparatus or the like can be connected. It can be tilted by means of pneumatic pistons 64 about a horizontal axis 65 parallel to the rear wall 6 so that it can be changed over between a take-over position and a transfer position. In the former position (FIG. 12) its front end is located below the pivot beam 53 when the latter is in the transfer position and its top falls away steeply in the transport direction; in the latter position, its top falls away more gently and its rear end projects away a fairly long distance from the rear wall 6 of the housing 1. The removal conveyor apparatus 62 furthermore comprises a horizontal flat impact plate 66 having an impact edge 67 which is parallel to the pivot beam 53 in the transfer position and can be advanced and withdrawn by means of a pneumatic piston 68 obliquely between the pivot beam 53 and the front end of the removal conveyor 63.

A return conveyor 69, a belt conveyor, runs from the rear wall 6 (FIG. 1) just above the base 2 to the front wall 5, through an opening therein and then ascends above the edge of the container 7. It runs below the edge gripping apparatus 52, the transfer gripper 40 and the corner gripping apparatus 12 and serves as return apparatus for laundry articles which were not correctly gripped and have consequently fallen.

The device is controlled by a microprocessor which processes the output signals of the sensors and generates control signals, in particular for the various conveyors, pneumatic pistons and clamps.

Figure 3:
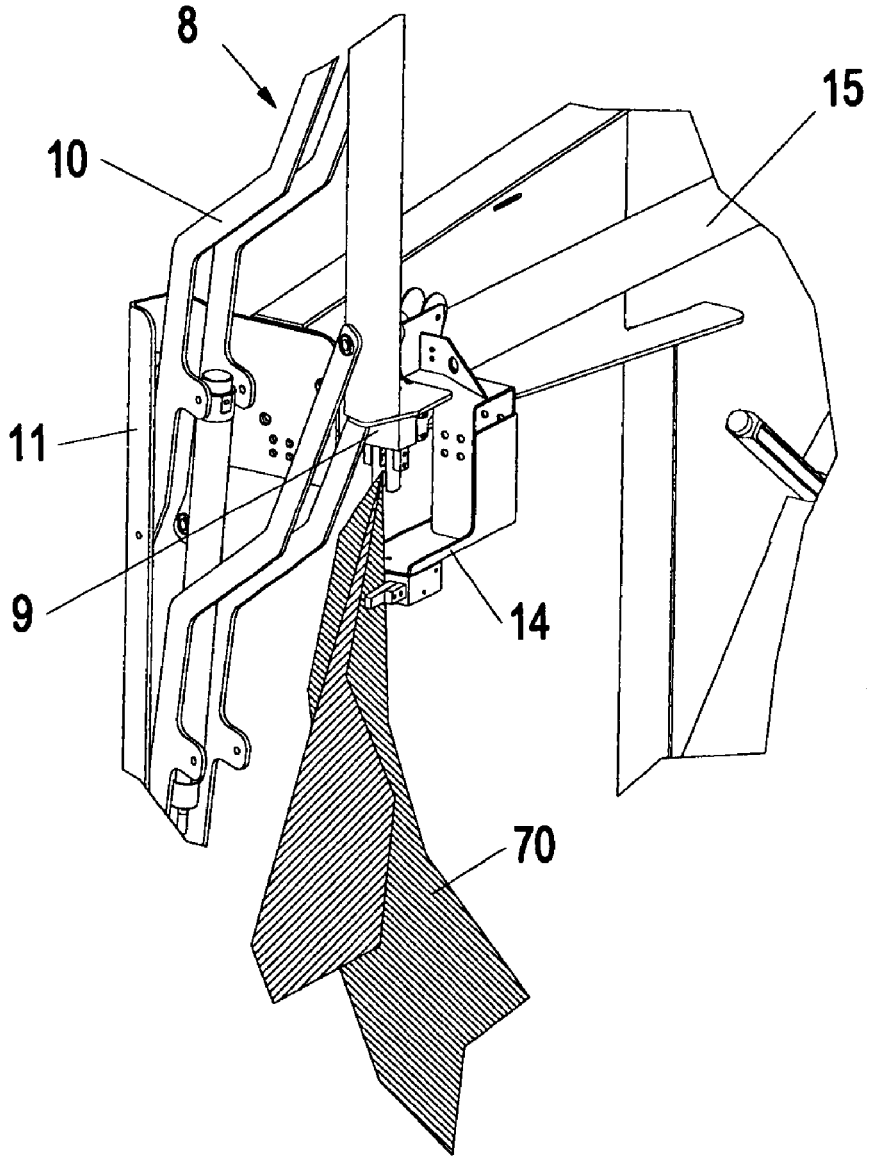
FIG. 3 shows a preliminary gripper and a positioning gripper during the transfer of a laundry article from one to the other.
Figure 4:
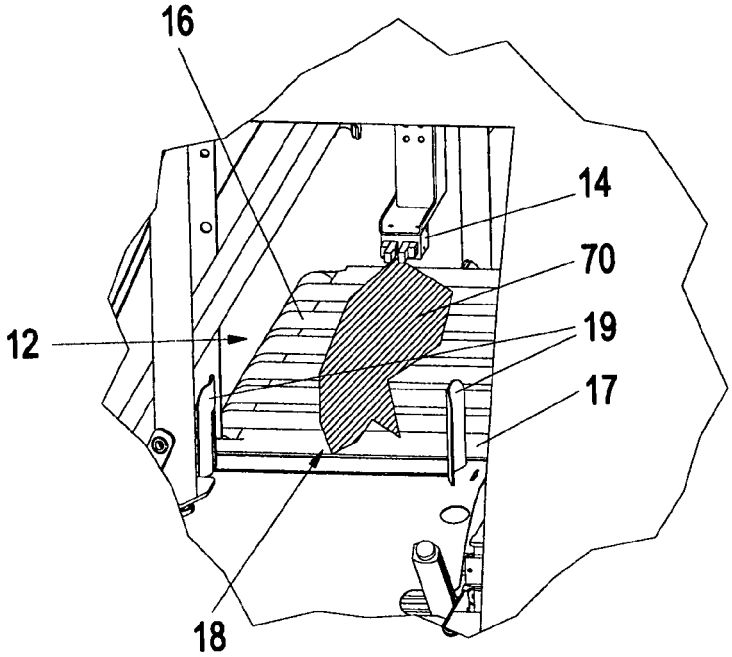
FIG. 4 shows an oblique plan view of a part of a corner gripping apparatus with the positioning gripper.
Figure 5:
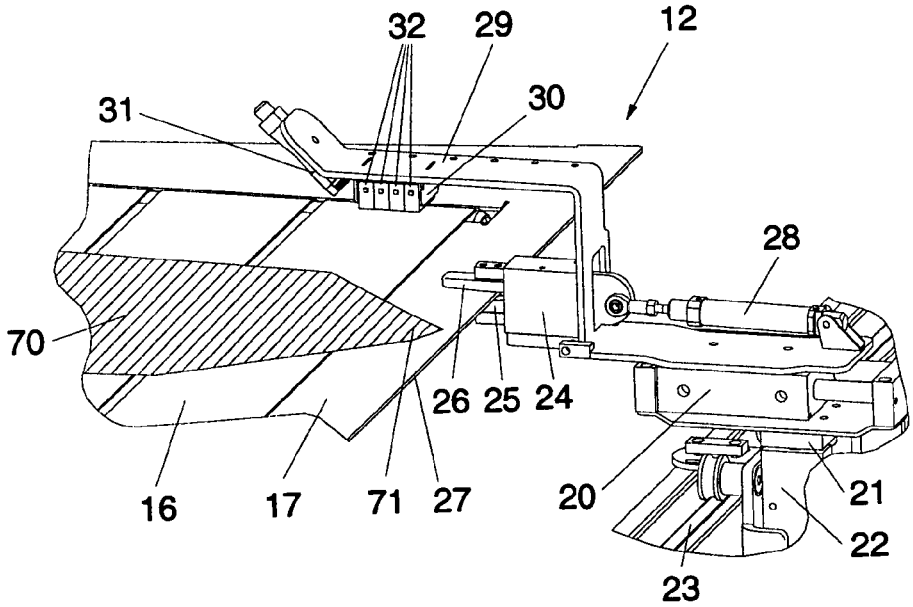
FIG. 5 shows, on a larger scale, an oblique plan view of a part of the corner gripping apparatus with a corner gripper.
Figure 6:
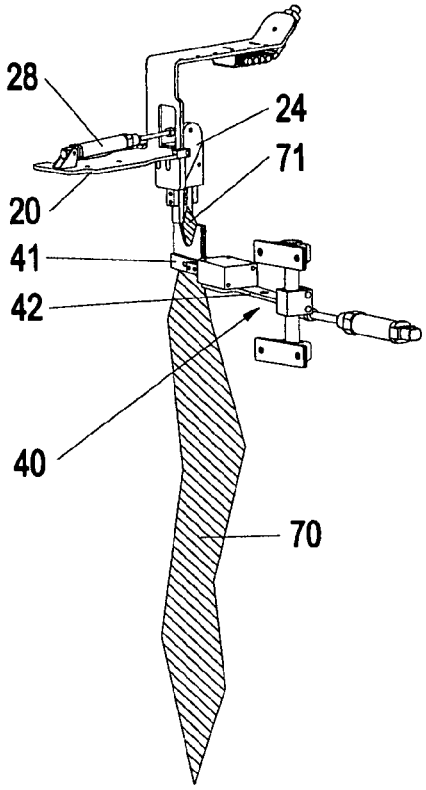
FIG. 6 shows a transfer gripper during the acceptance of the laundry article from the corner gripper.

Laundry articles which, for example, after washing and drying, are to be fed to a further processing step, in particular, rectangular laundry items, such as, for example, towels which are made of terry cloth and are to be folded or upholstery covers which are to be passed through a mangle, are placed in disordered heaps in the container 7. The preliminary gripper 8 lowers the open clamp 9 into the container until it encounters resistance. In this gripping position, it is closed and is raised to the transfer position (FIG. 3). Usually, it has gripped a single rectangular laundry item 70. The positioning gripper 14 is now moved in the open state below the transfer position and is closed, whereupon the clamp 9 of the preliminary gripper 8 is opened.

The positioning gripper 14 now travels in the positioning direction along the rail 15 into the interior of the housing 1 (FIG. 4), with the result that the laundry item 70 is drawn through the light barrier 19 and onto the positioning strip 18. The light barrier 19 thus detects the passage of the rear end of the laundry article 70 and stops the positioning conveyor 12. The positioning gripper 14 is opened and the laundry article 70 falls completely onto the positioning strip 18. The rearmost tip in the positioning direction now rests on the edge plate 17, where it may also project slightly beyond the edge, and the remainder rests on the transverse conveyor 16. The latter is now caused to move and transports the laundry article 70 towards the middle and is stopped. The slide 22 (FIG. 5) is now moved along the rail 23 in the transverse direction so that the tongue 29 with the scanner 30 travels transversely over the scanning strip and hence over that tip of the laundry article 70 which rests on the edge plate 17, which tip is thus scanned from above.

Those sensors 32 which traverse the tip of the laundry article 70 respond, and both transits, edge plate—laundry article and laundry article—edge plate, are registered, i.e. the positions of both edge points of the laundry article 70 below the track of the respective sensor are detected and are fed to the microprocessor. Of the results of the sensors 32 which have responded at all, those of the sensor which is rearmost in the positioning direction and closest to the gripping edge 27 of the edge plate 17 are used for the further evaluation, and all further results are not taken into account. This means that, independently of the exact position of the tip of the laundry article 70 in the positioning direction, which cannot be very accurately controlled with an acceptable effort, only the results of that responding sensor which is closest to the rear end of the laundry article 70 are ever used.

Interpolation is now carried out between the two edge points determined by this sensor, for determining a corner position, for example by calculating the mean value and modifying it slightly if necessary using empirical values. However, it is possible to dispense with a determination of the corner position and gripping of the laundry article if the distance of said edge points exceeds a certain threshold, since it must then be assumed that the laundry article is unfavorably positioned and no reliably grippable corner is present. Otherwise, the slide 22 travels to a position such that the position of the corner gripper 24 in the transverse direction corresponds to the corner position determined. The holder 20 is then advanced so that the corner gripper 24 reaches the gripping position and, after an air pulse from the blow nozzle 31 which presses the laundry article against the edge plate 17, its upper jaw 26 is lowered towards the edge plate 17 and hence the corner of the laundry article 70 is clamped between these parts, while the lower jaw 25 of the corner gripper 24 projects below the edge plate 17. The holder 20 is then withdrawn until the corner gripper 24 is free of the edge plate 17 and the tip of the laundry article 70 is clamped between the upper jaw 26 and the lower jaw 25. The gripped position usually corresponds with sufficient accuracy to a corner 71 of the laundry article 70. By moving said laundry article by means of the transverse conveyor 16, time is gained, since a further laundry article can already be drawn over the positioning strip 18 and set down during the scanning of a laundry article and the gripping of its corner. In addition, any laundry article remaining on the support surface is moved by the movement of the transverse conveyor 16 over the edge thereof so that it falls onto the return conveyor 69.

The slide 22 is then moved further and at the same time the base 21 is raised and the corner gripper 24 is tilted downwards by means of the pneumatic piston 28 until it is present (cf. FIG. 6) just above the open clamp 41 of the transfer gripper 40 so that the laundry article 70 hangs between the jaws thereof. The clamp 41 is then closed, the V-shaped recess on the top thereof allowing space for the corner gripper 24, which is then opened. The band 42 supporting the clamp 41 is now rotated through slightly less than 900 about a perpendicular axis, whereupon (FIG. 7) the tensioning gripper 35 with open clamp 37 is moved to a position in which the jaws thereof coincide with the V-shaped recess, whereupon they are closed and the clamp 41 of the transfer gripper 40 is opened. The corner 71 previously held by the corner gripper 24 is now held by the clamp 37 of the tensioning gripper 35.

The tensioning gripper 35 is now moved in the tensioning direction along the rail 36 up to the transfer point at the end thereof. The laundry article 70 encounters the channel 43 and is drawn over the top thereof and past the open flap 49 of the end gripping unit (FIG. 8), said laundry article being pushed together laterally somewhat. The passage of the end of the laundry article 70 is registered by the end sensor unit, i.e. it is detected in each case by the two rows of sensors 51, and the subsequent time when the rearmost tip of the laundry article 70 will pass the end gripping unit is calculated in advance from the times when in each case the last sensor of the row detects the passage of the rearmost edge. Just before this time, the flap 49 is pulled downward and the rearmost tip of the laundry article 70 is clamped, i.e. said laundry article is gripped in the region of the rearmost tip and is held. It is thus fairly tensioned between the tensioning gripper 35 and the end gripping unit and sags only slightly. Usually, an edge 72 of the laundry article 70 which is adjacent to the corner 71 held by the clamp 37 of the tensioning conveyor 35 now hangs down freely, but it also happens that it is folded back.

Figure 9:
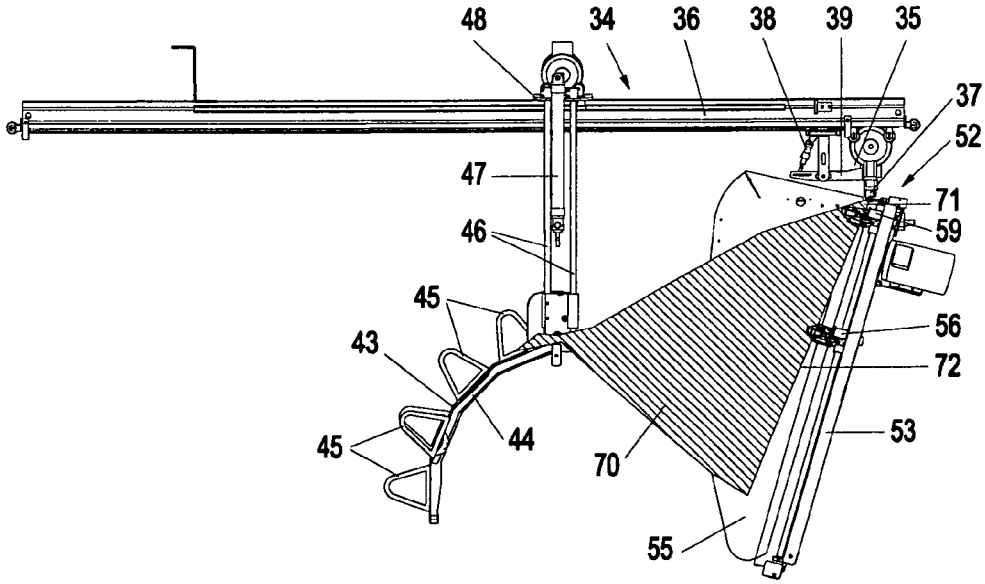
FIG. 9 shows, from the side, the tensioning conveyor and other parts of the edge gripping apparatus, with the tensioning gripper at the end of the tensioning conveyor.
Figure 10:
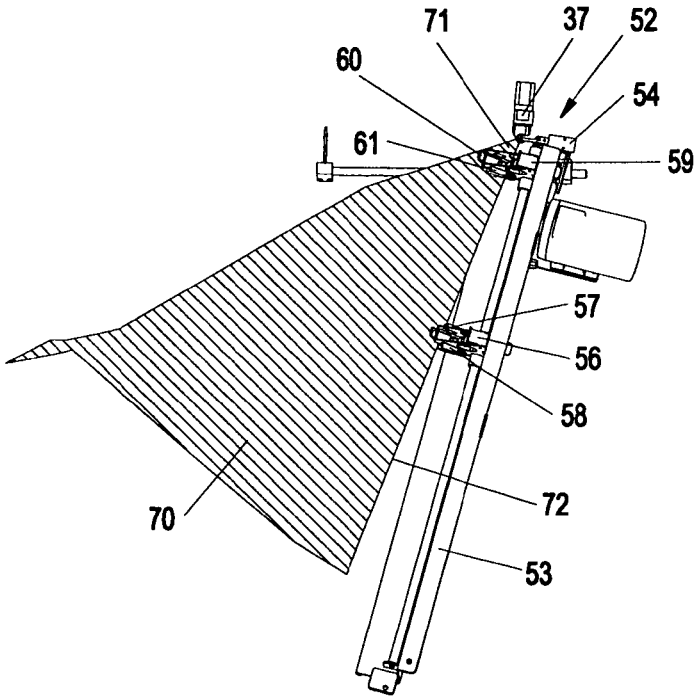
FIG. 10 shows the tensioning conveyor and a pivot beam of the edge gripping apparatus before the takeover of the laundry article by the latter.

Simultaneously with the activation of the end gripping unit, the carriage 48 is caused to move and the channel 43 with the tensioning gripper 35 is moved with it until it reaches the transfer position, whereupon the tensioning conveyor 34 and the carriage 48 are stopped. Towards the end of this movement, the edge 72 encounters the guide surface formed by the front of the guide plate 35 and slides along said surface towards the pivot beam 53 (FIG. 9). When the tensioning gripper 35 comes to a stop, the edge 72, if it was folded back, is freed by brief shaking of the clamp 37 by means of the pneumatic piston 38 and possibly an air pulse from above from a blow nozzle. The free edge 72 then usually makes an acute angle with the pivot beam 53. The channel 43 is now lowered, with the result that the edge 72 is pivoted towards the pivot beam 53 and finally (FIG. 10) reaches the open clamps 57, 60 of the edge grippers 56, 59. At the same time, it is registered by the sensors 58, 61 which act as edge sensors. Thereafter, the first edge gripper 56 is moved towards the lower end of the pivot beam 53, which end is remote from the transfer point, until the sensor 58 now used as a corner sensor detects the end of the edge 62 and hence a further corner 73 which is opposite the corner 71 still held by the clamp 35 of the tensioning gripper 33. Thereafter, the first edge gripper 56 is stopped and its clamp 57 and also the clamp 60 of the second edge gripper 59 are closed.

Figure 11:
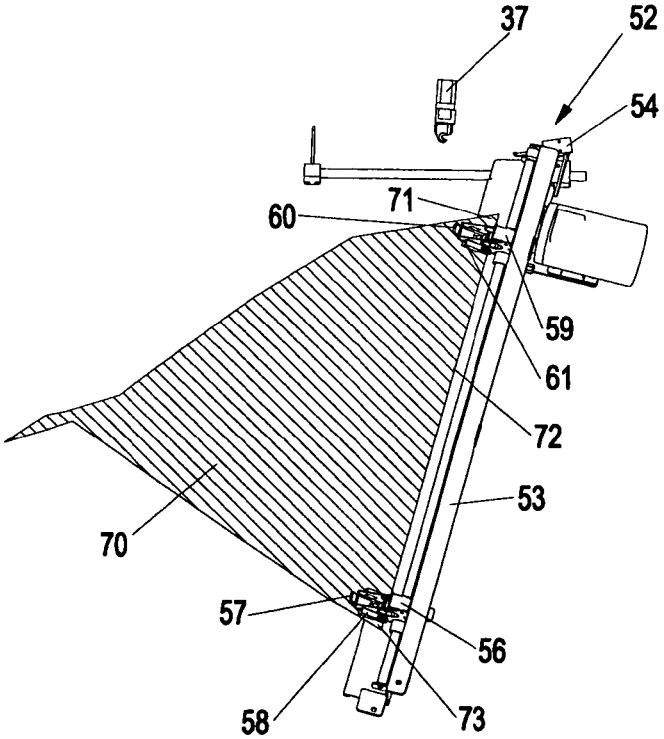
FIG. 11 shows the tensioning conveyor and the pivot beam of the edge gripping apparatus after the takeover of the laundry article by the latter and, FIG. 12 shows the pivot beam of the edge gripping apparatus and an impact plate during the transfer of the laundry article to a removal conveyor.
Figure 12:
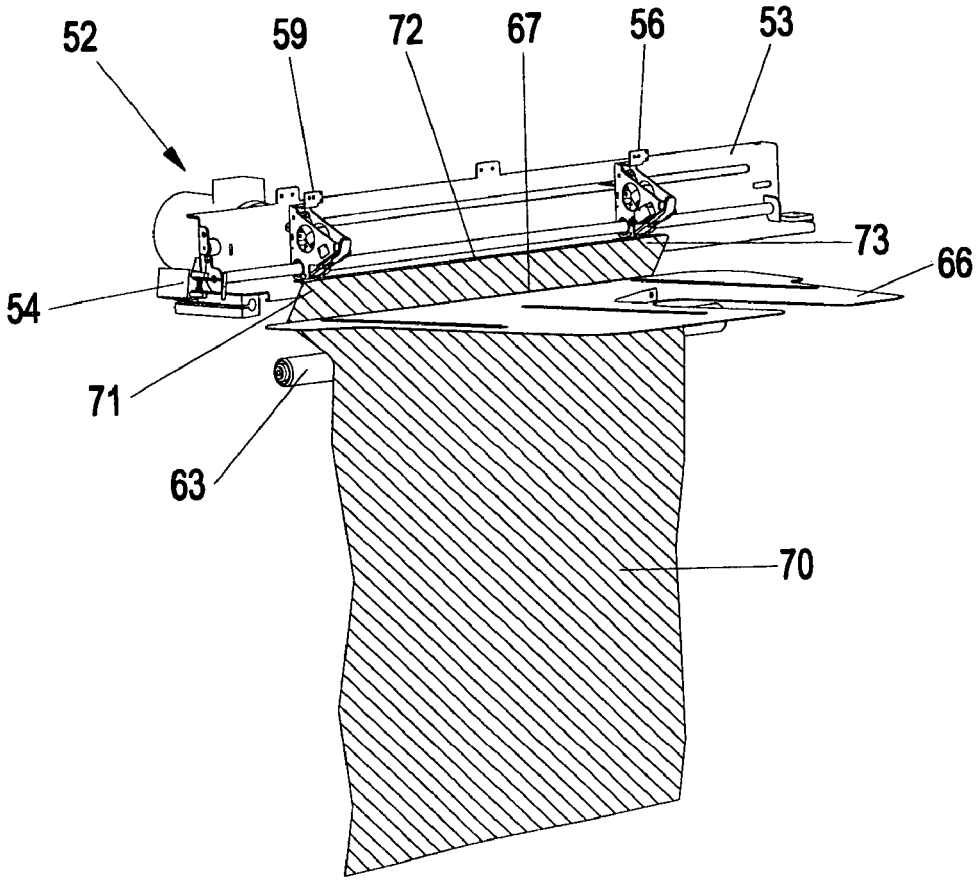

After the opening of the clamp 37 of the tensioning gripper 35, the two corners 71, 73 bounding the edge 72 are now held by the clamps 57, 60 of the edge grippers 56, 59 (FIG. 11). The pivot beam 53 is now swivelled to its transfer position in which it lies horizontally above the front end of the removal conveyor 63 (FIG. 12). The laundry article 70 has thus been aligned and can be transferred to the removal conveyor 63. This is effected by advancing the impact plate 66. Shortly after the impact edge 67 thereof has come up against the laundry article 70 below the edge 72, the clamps 57, 60 of the edge grippers 56, 59 are opened and the front section of the laundry article 70 which is adjacent to the edge 72 falls onto the removal conveyor 63 which is present in the take-over position. Because its top falls away sharply in the transport direction, withdrawal of the laundry article 70 by the weight of the part not yet resting on the removal conveyor 63 is prevented. As soon as a larger part of the laundry article 70 rests on the removal conveyor 63, the latter is tilted into the transfer position by the pneumatic piston 64 so that the laundry article 70 can be taken over by the directly connected feed conveyor of a processing device.

If a laundry article is already gripped, for example, by the preliminary gripper 8 at an unfavourable point or if it is particularly unfavorably positioned, e.g. is twisted, it is possible that the corner was not gripped or only poorly gripped in the corner gripping apparatus 12 and the laundry article remains on the transverse conveyor 16 or falls off during the attempted take-over of the corner by the transfer gripper 40 or by the tensioning gripper 35. It is also possible that the second corner cannot be gripped in the edge gripping apparatus 52 and the laundry article slides away from the removal conveyor 63 in a direction opposite to the transport direction or that the laundry article falls off at some other point. In all these cases, the function of the device according to the invention is not permanently disturbed. The laundry article only falls onto the return conveyor 69 and is—generally in a more favourable state, for example at least partially untwisted if it was twisted—transported back into the container 7, where it can be gripped again by the preliminary gripper 8.

Of course, many deviations from what has been described above are possible without departure from the scope of the invention. Thus, the relative movement between the laundry article 70 and the scanner 30 in the corner gripping apparatus 12 can also be produced by transverse displacement of the former, for example by means of the transverse conveyor 16. Instead of an optical scanner, it is also possible to use a mechanical or electrical scanner. In addition, it is also possible to form the scanner, for example, as a two-dimensional field of optical sensors. In this case, the scanning is preferably effected without relative movement. It should also be pointed out that the device according to the invention need comprise only a corner gripping apparatus as described. A further alignment of the laundry article can also be effected in a manner other than that described, for example manually or by other automatically operating means. In this case, the return apparatus need only run through below the corner gripping apparatus.

LIST OF REFERENCE SYMBOLS

1 Housing
2 Base
3, 4 Side walls
5 Front wall
6 Rear wall
7 Container
8 Preliminary gripper
9 Clamp
10 Parallelogram suspension
11 Post
12 Corner gripping apparatus
13 Positioning conveyor
14 Positioning gripper
15 Rail
16 Transverse conveyor
17 Edge plate
18 Positioning strip
19 Light barrier
20 Holder
21 Base
22 Slide
23 Rail
24 Corner gripper
25 Lower jaw
26 Upper jaw
27 Gripping edge
28 Pneumatic piston
29 Plate
30 Scanner
31 Blow nozzle
32 Sensors
33 Edge gripping apparatus
34 Tensioning conveyor
35 Tensioning gripper
36 Rail
37 Clamp
38 Pneumatic piston
39 Lever
40 Transfer gripper
41 Clamp
42 Band
43 Channel
44 Base
45 Bow
46 Rods
47 Pneumatic piston
48 Carriage
49 Clamp
50 Holes
51 Sensors
52 Edge gripping unit
53 Pivot beam
54 Pivot bearing
55 Guide plate
56 First edge gripper
57 Clamp
58 Sensor
59 Second edge gripper
60 Clamp
61 Sensor
62 Removal conveyor apparatus
63 Removal conveyor
64 Pneumatic piston
65 Axis
66 Impact plate
67 Impact edge
68 Pneumatic piston
69 Return conveyor
70 Laundry article
71 Corner
72 Edge
73 Corner

The invention claimed is:

1. Process for aligning a laundry article in which a corner thereof is found and is gripped by first gripping the laundry article at an arbitrary point and drawing it in a positioning direction substantially completely onto a support surface and stopping it, then determining the position of a rear end transverse to the positioning direction by scanning, approaching the determined position by a corner gripper displaceable transversely to the positioning direction and gripping the laundry article there.

2. Process according to claim 1 where the scanning is effected from above along at least one line running transversely to the positioning direction, and two edge points are detected and the determination of the position of the corner is effected by interpolation between the edge points.

3. Process according to claim 2 where the scanning is effected along a plurality of lines a distance apart in the positioning direction and the position of the corner is determined on the basis of the rearmost edge points detected.

4. Process according to claim 2 where the interpolation is based substantially on a calculation of the mean value of the edge points detected.

5. Process according to claim 1 where the scanning is effected optically.

6. Process according to claim 1 where the rear part of the laundry article is pressed against the support surface before or during the scanning.

7. Device for aligning a laundry article, comprising a corner gripping apparatus, which has a support surface for the laundry article and a positioning gripper which can be moved along a positioning direction over the support surface, a scanner for detecting the position of a rearmost part of the laundry article on a scanning strip extending in a transverse direction transversely to the positioning direction, and a corner gripper which is displaceable along the scanning strip for approaching this position.

8. Device according to claim 7 where the scanner is displaceable in the transverse direction over the scanning strip of the support surface and has a plurality of preferably optical sensors in succession in the positioning direction.

9. Device according to claim 8 where the number of sensors is at least two and preferably not more than four.

10. Device according to claim 8 where the distance between two successive sensors is between 10 mm and 20 mm.

11. Device according to claim 7 where the scanning strip is bordered by a gripping edge, and the corner gripper comprises a lower jaw which can be advanced from the gripping edge below the scanning strip, and an upper jaw which can be advanced above said scanning strip and can be lowered onto it.

12. Device according to claim 7 where the scanner and the corner gripper are connected to one another in such a way that they can be displaced together in the transverse direction.

13. Device according to claim 7 where the corner gripping apparatus comprises a blow nozzle which is arranged above the support surface and which is directed obliquely downwards and against the positioning direction onto the scanning strip.

14. Device according to claim 11 where the support surface comprises the tops of a thin edge plate which is adjacent to the gripping edge and the top of which also forms the scanning strip, and of a transverse conveyor adjacent thereto in the positioning direction and aligned parallel to the scanning direction.

15. Device according to claim 7, comprising a sensor, preferably a light barrier, arranged below the positioning gripper before the support surface in the positioning direction, for detecting the rear end of the laundry article and allowing control of the positioning gripper as a function thereof.

16. Device according to claim 7, comprising a preliminary gripper which is arranged upstream of the positioning gripper and is adjustable between a lower gripping position and a higher transfer position in which the positioning gripper can accept a laundry article from it.

17. Device according to claim 7, further comprising an edge gripping apparatus having an edge gripping unit which has a pivot beam which can be transferred between a take-over position, in which it points downwards from a take-over point, and a transfer position in which it is aligned horizontally, having at least one edge sensor a distance away from the take-over point and intended for detecting a grippable edge of the laundry article and a corner sensor for detecting a corner of the laundry article at the lower end of the grippable edge and a first edge gripper displaceable in the longitudinal direction on the pivot beam, and having a tensioning conveyor, which comprises a tensioning gripper, for transporting a laundry article gripped by the latter at a corner in a substantially horizontal tensioning direction to the take-over point, and having an end gripping unit which is arranged before the edge gripping unit below the tensioning conveyor and has an end sensor unit for registering the end of the laundry article and a clamping unit for holding said laundry article, the position of which relative to the edge gripping unit can be changed for aligning the grippable edge.

18. Device according to claim 17 where the corner sensor is connected to the first edge gripper.

19. Device according to claim 17 where the edge gripping unit comprises a second edge gripper which is likewise displaceable in the longitudinal direction on the pivot beam and is suitable for taking over the gripped corner of the laundry article from the tensioning gripper at the take-over point.

20. Device according to claim 17, the end gripping unit comprising a channel which is suspended below the tensioning conveyor and narrows in the tensioning direction and at the end of which the clamping unit is arranged.

21. Device according to claim 20 where the channel is convex upwards in the tensioning direction.

22. Device according to claim 20 where the end sensor unit comprises a plurality of optical sensors distributed over the channel.

23. Device according to claim 22 where at least two of the sensors are a distance apart in the tensioning direction.

24. Device according to claim 17 where the edge gripping unit comprises a guide surface for guiding the laundry article, which guide surface is arranged below the tensioning conveyor and extends from the pivot beam in its take-over position, deviating slightly laterally, substantially in a direction opposite to the tensioning direction.

25. Device according to claim 17 where one end of the pivot beam is mounted on a pivot bearing arranged in the region of the take-over point, in order to permit changeover between the take-over position and the transfer position.

26. Device according to claim 17, comprising a transfer gripper having a clamp which is suitable for taking over the laundry article from the corner gripper and transferring it to the tensioning gripper.

27. Device according to claim 17, comprising a removal conveyor apparatus for receiving the laundry article and transporting it away, having a removal conveyor, preferably a belt conveyor, the front end of which, at least in a take-over position, is located below the pivot beam in the transfer position and runs away from the pivot beam transversely thereto.

28. Device according to claim 27 where the removal conveyor is tiltable about an axis running transversely to the transport direction, so that it can be changed over between the take-over position, in which its top falls away sharply in the transport direction, and a transfer position in which it falls away at most slightly.

29. Device according to claim 27 where the removal conveyor apparatus comprises an impact edge which is parallel to the longitudinal direction of the pivot beam in the transfer position and can be advanced and withdrawn below said pivot beam transversely to said longitudinal direction.

30. Device according to claim 16, comprising a return apparatus running through below the corner gripping apparatus to the preliminary gripper, for returning laundry articles which have fallen down to the gripping region of the preliminary gripper.

31. Device according to claim 30 where the return apparatus is in the form of a return conveyor.

32. Process for aligning a laundry article in which a corner thereof is found and is gripped by first gripping the laundry article at an arbitrary point and drawing it in a positioning direction substantially completely onto a support surface and stopping it, then shifting the laundry article in a direction transverse to the positioning direction and then determining the position of a rear end transverse to the positioning direction by scanning, approaching the determined position by a corner gripper displaceable transversely to the positioning direction and gripping the laundry article.

* * * * *